United States Patent [19]

Fein

[11] Patent Number: 4,817,699

[45] Date of Patent: Apr. 4, 1989

[54] WALL TRACK FOR FABRIC WALL COVERINGS

[75] Inventor: Harvey C. Fein, New York, N.Y.

[73] Assignee: DFB Sales, Inc., Long Island City, N.Y.

[21] Appl. No.: 175,443

[22] Filed: Mar. 30, 1988

[51] Int. Cl.[4] ..... E06B 3/80

[52] U.S. Cl. ..... 160/327; 160/328; 160/354; 160/89; 160/368.1; 160/391; 52/222; 52/273; 40/617; 24/304

[58] Field of Search ..... 160/327, 328, 329, 378, 160/89, 354, 368.1, 382, 383, 391; 52/222, 273, 459, 762, 773; 16/4, 5; 40/617; 24/304

[56] References Cited

U.S. PATENT DOCUMENTS

| | | | |
|---|---|---|---|
| 3,057,401 | 10/1962 | Gomory et al. | 160/89 |
| 4,018,260 | 4/1977 | Baslow | 160/327 |
| 4,069,542 | 1/1978 | Carder | 24/304 X |
| 4,197,686 | 4/1980 | Baslow | 160/327 X |
| 4,403,642 | 9/1983 | Morris | 160/328 X |
| 4,447,935 | 5/1984 | Ausnit | 160/391 X |
| 4,625,490 | 12/1986 | Baslow | 160/327 X |
| 4,676,016 | 6/1987 | Phillips et al. | 160/383 X |

*Primary Examiner*—Ramon S. Britts
*Assistant Examiner*—David G. Kolman
*Attorney, Agent, or Firm*—Blum Kaplan

[57] ABSTRACT

An extruded plastic wall track for affixing fabric to a wall includes an elongated base adapted to be secured to a wall which includes a generally flat surface having first and second edges. A first shoulder extends outwardly from the first edge of the base away from the wall and a second shoulder extends outwardly from the second edge of the base away from the wall. The first shoulder includes a first lip and the second shoulder includes a panel hingedly secured thereto having a second lip adapted to lock over the first lip. The second shoulder includes a flange extending outwardly therefrom and essentially parallel to the base and spaced therefrom, the flange being adapted to support a lining material spaced from the wall.

4 Claims, 2 Drawing Sheets

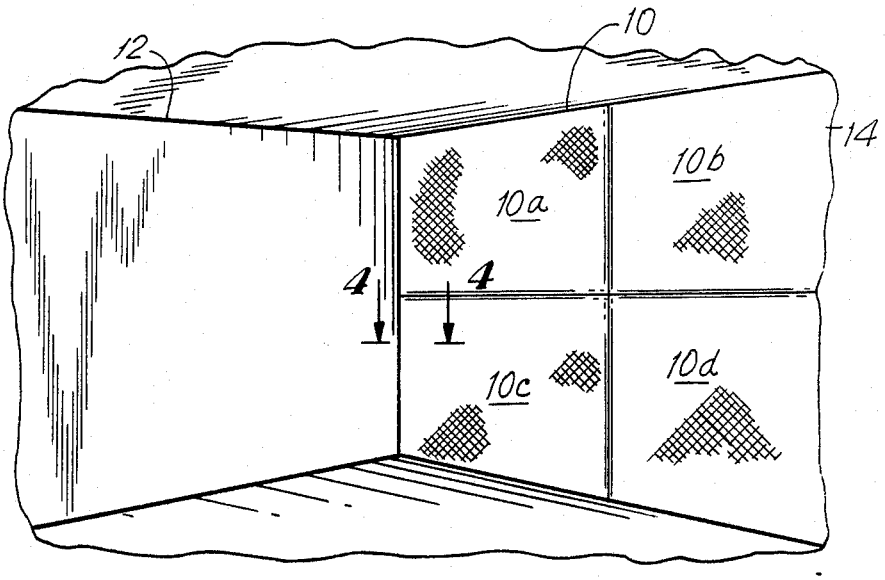
FIG. 1
FIG. 2
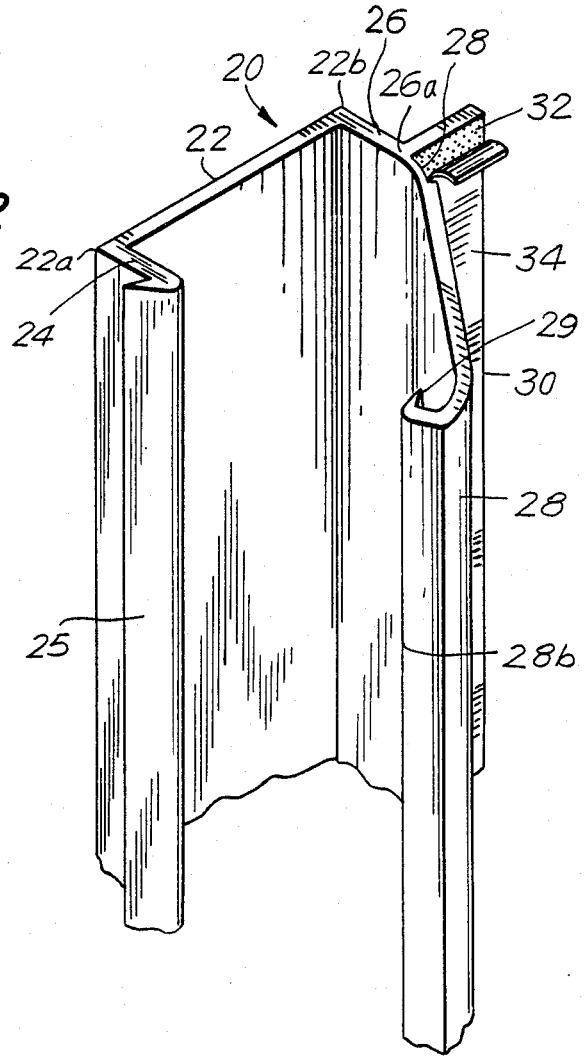

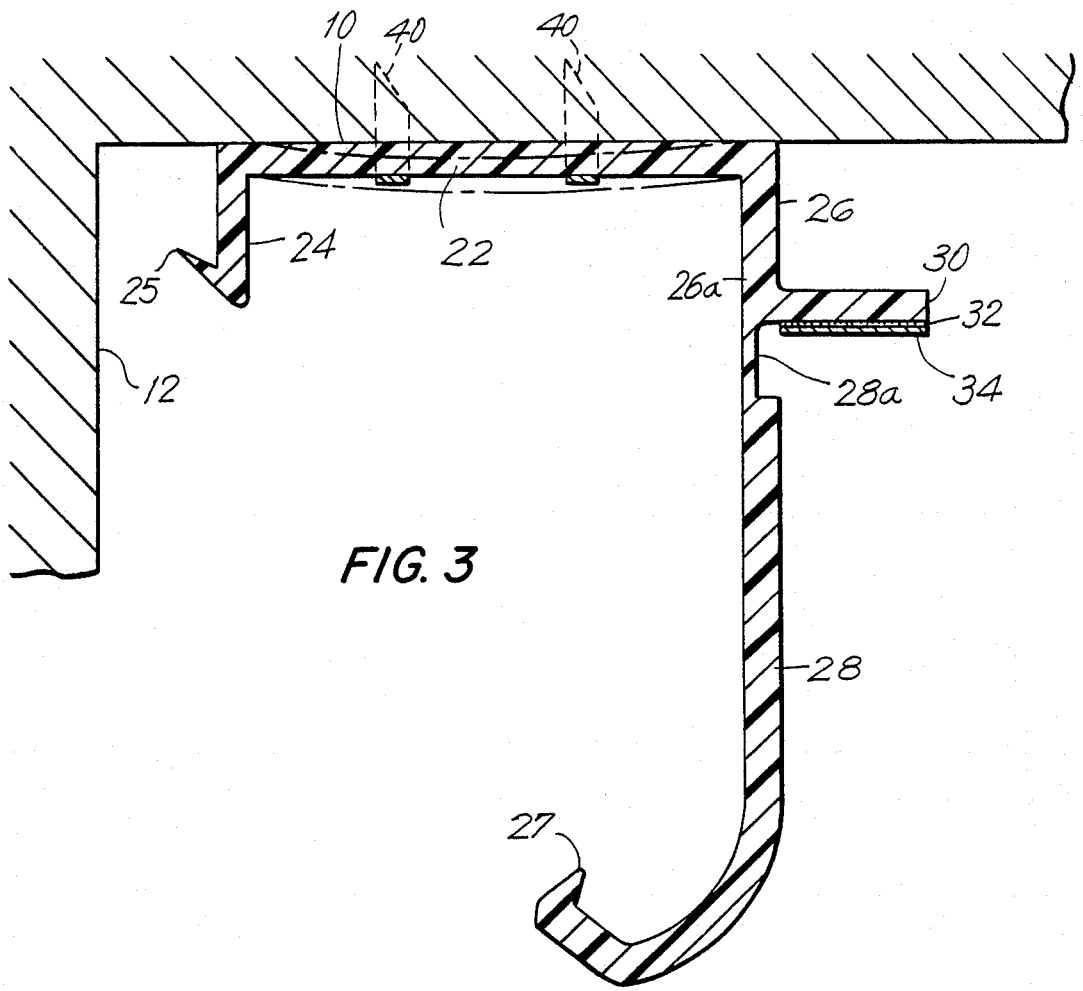
FIG. 3
FIG. 4
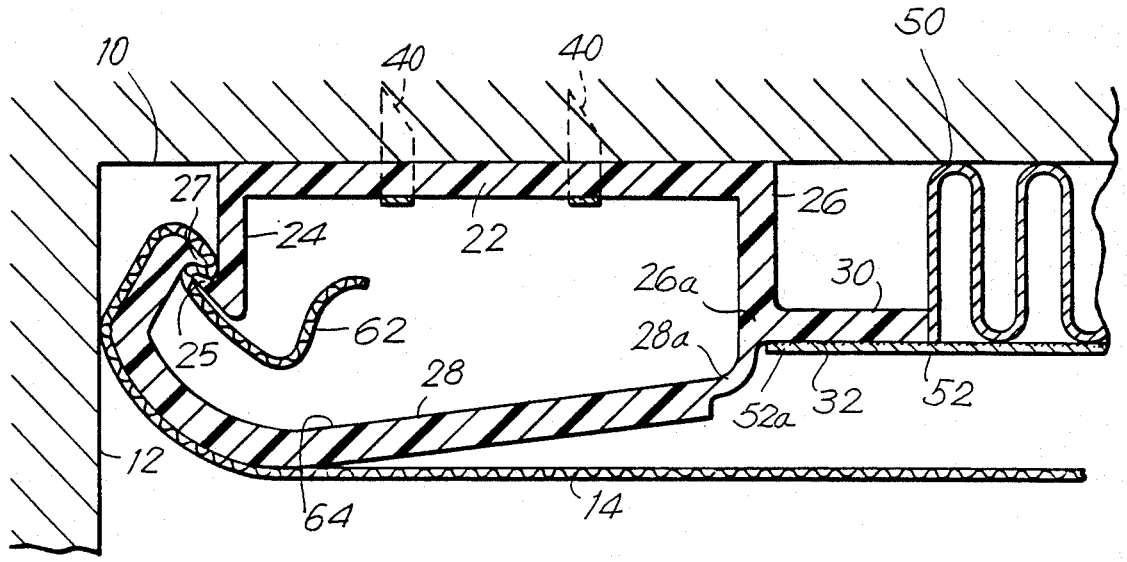

WALL TRACK FOR FABRIC WALL COVERINGS

BACKGROUND OF THE INVENTION

The present invention is directed generally to a wall track for supporting fabrics on a wall and, in particular, to a wall track for supporting fabrics on a wall which includes a flange extending therefrom and spaced from the wall adapted to secure a lining spaced from the wall below the fabric to enhance the appearance of the installation.

In recent years, it has become quite fashionable to upholster walls of rooms in a building by suspending a fabric wall covering therefrom. In one such type of system, plastic track pieces are glued or otherwise affixed to the periphery of a wall, and cut sections of fabric are supported from and suspended by the track pieces to cover the wall. One such type of system using plastic track pieces and wall fabric for upholstering a wall is described in U.S. Pat. No. 4,018,260. The U.S. Pat. No. 4,018,260 describes the process of installing one type of plastic track having a dilatable inlet on a wall and thereafter applying fabric to the wall which is held thereto after being stuffed into the dilatable inlet of the plastic track.

Another type of plastic track used to support fabric on a wall is disclosed in U.S. Pat. No. 4,676,016. The same type of track is also disclosed in German Pat. No. 2,207,954. In the track disclosed in the U.S. Pat. No. 4,676,016 and the German '954 patent, the track is formed from a plastic material. The track includes a planar portion adapted to be affixed to the wall having a first shoulder extending outwardly therefrom and a second movable portion hingedly secured to the base portion and adapted to snap lock into the first portion whereby fabric can be held between the locking jaws thereof.

In some instances, fabric selected for use as wall upholstry to be held by plastic wall tracks is not sufficiently opaque and therefore permits viewing of the materials under the fabric on the wall such as filling or padding material. After installation of the fabric, the padding or other filling material can be seen through the fabric, thereby destroying the overall appearance of the wall system.

Accordingly, it is desirable to install a lining over the padding or filling material to prevent exposure thereof through the fabric. The present invention provides a plastic wall track which includes an extension on the track spaced from the wall adapted to permit ready installation and support of such a lining material.

SUMMARY OF THE INVENTION

Generally speaking, in accordance with the present invention, an extruded plastic wall track for affixing fabric to a wall is provided. The track includes an elongated base adapted to be secured to the wall, with the base including a generally flat surface having first and second opposed edges therealong. A first shoulder extends outwardly from the first edge of the base away from the wall and a second shoulder extends outwardly from the second edge of the base away from the wall. The first shoulder includes a first lip extending therealong. The second shoulder includes a panel hingedly secured thereto having a second lip adapted to lock over the first lip to capture the fabric therebetween. The second shoulder also includes an elongated projection or flange extending outwardly therefrom and essentially parallel to the base. The flange is spaced from the base and adapted to support a lining material spaced from the wall.

In a preferred embodiment, an adhesive material is applied to the flange to permit easy and quick affixing of the lining to the track.

Accordingly, it is an object of the present invention to provide an improved wall track for affixing fabric coverings to a wall.

Another object of the present invention is to provide an improved wall track which permits ready installation of a lining material to the wall underneath the fabric.

A further object of the present invention is to provide an improved wall track having a flange extending therefrom adapted to support a lining material.

Yet another object of the present invention is to provide an improved wall track which permits simle, easy and quick installation of a lining material to a wall prior to installation of the fabric.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of the corner of a room showing a wall upholstered with a wall fabric and supported by a plastic wall track constructed in accordance with a preferred embodiment of the present invention;

FIG. 2 is a perspective view of a plastic wall track constructed in accordance with a preferred embodiment of the present invention;

FIG. 3 is a cross-sectional view of the wall track depicted in FIG. 2 shown affixed to a wall, with the track shown in an open position; and FIG. 4 is an enlarged sectional view taken along line 4—4 of FIG. 1 showing the track in its closed, locked position supporting a fabric and a lining material thereon.

DETAILED DESCRIPTION OF THE PREFERRED EMBODIMENT

Reference is made first to FIG. 1 of the drawings which depicts a corner of a room showing a first upholstered wall 10 and a second non-upholstered wall 12. A fabric material 14 is supported on wall 10 to form a plurality of panels 10*a* through 10*d*.

Referring now to FIGS. 2 through 4, the improved track, generally indicated at 20, which is utilized to support fabric 14 on wall 10 is depicted in detail. Track 20 is formed from an extruded plastic material and includes an elongated base 22 which is generally flat having a first edge 22*a* and a second opposed edge 22*b*. Base 22 is generally rectangular in shape. A first shoulder 24 extends generally perpendicularly out from first edge 22*a* of base member 22 away from wall 10. First shoulder 24 includes a first lip on jaw 25. A second shoulder 26 extends essentially perpendicularly out from second edge 22*b* of base member 22 in the same direction as first shoulder 26.

A panel 28 is hingedly affixed to the outer edge 26*a* of second shoulder 26 through a weakened line of material or living hinge 28*a*. Panel 28 includes a second lip or jaw 29 on the outer edge 28*b* thereof adapted to interlock with jaw 25 on first shoulder 24.

A projection or flange 30 extends outwardly from outer edge 26*a* of second shoulder 26 and in a direction away from base 22. Flange 30 extends essentially perpendicularly to base member 22 of track 20.

An adhesive material 32 may be applied to the outer surface of flange 30 and covered by a removable strip 34.

In addition to adhesive material 32 staples or other similar fastening devices may be used to secure lining material 52 to flange 30.

As depicted in FIGS. 3 and 4, base 22 is secured to wall 10 by means of fasteners such as staples 40. Panel 26 initially is kept spaced from first shoulder 24 to permit installation of the fabric.

The procedure for installing the padding or filling material, lining and exterior fabric will now be explained with reference to FIGS. 3 and 4. Initially, a padded or filling material 50 is applied to wall 10 so as to extend within the perimeter area defined by track 20 around wall 10. Flange 30 formed on second shoulder 26 of track 20, is spaced a sufficient distance from wall 10 to provide clearance for padding 50. Thereafter, protective strip 34 is removed from flange 30 to expose adhesive material 32. The edge 52*a* of a lining material 52 is secured to adhesive material 32 so as to hold lining 52 thereon. The lining is supported over padding material 50 in order to cover same. Lining material 52 can be appropriately colored or shaded to mask filling material 50 so that it is not visible through the fabric.

Fabric material 14 is then placed over lip 27 formed at the open end of panel 26 and is thereafter snapped over lip 25 formed at the outer end of first shoulder 24. In this manner, as depicted in FIG. 4, the selvage 62 of fabric 60 is captured between interlocking lips 25 and 27 and extends into the opening 64 defined by closed track 20.

This procedure is continued so that fabric 60 extends between opposing track sections to provide upholstered wall panels 10*a* through 10*d* as depicted in FIG. 1. Even if fabric 60 is somewhat translucent so as to permit limited viewing of the underlying materials in a given lighting condition, lining 52 will mask and enhance the appearance of the entire installation.

Flange 30 is spaced from base 22 and hence wall 10 in order to permit sufficient clearance for padding material 50 to be inserted and installed. By providing such a flange, the lining can be quickly, easily and readily installed on the wall without the need for additional materials. Moreover, since flange 30 forms a part of track 20, the cost of installation is reduced since less installation materials are required. The adhesive material on flange 30 permits simple and efficient installation.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A plastic wall track for affixing fabric to a wall comprising an elongated base adapted to be secured to the wall, said base including a generally flat surface having first and second opposing edges, a first shoulder extending outwardly from the first edge of said base away from the wall, a second shoulder extending outwardly from the second edge of said base away from said wall, said first shoulder including a first lip, said second shoulder including a panel hingedly secured thereto having a second lip adapted to lock over said first lip to capture said fabric therebetween, said second shoulder including a flange extending outwardly therefrom essentially parallel to said base, said flange being spaced outwardly from said base, said flange being adapted to support a lining material under said fabric, said flange including an adhesive material on the outer surface thereof, said lining material being supportable on said flange and affixable thereto by said adhesive material.

2. The plastic wall track as claimed in claim 1, wherein said flange includes a strip removably covering said adhesive material, said strip being removable to expose said adhesive material.

3. The plastic wall track as claimed in claim 1, wherein said second shoulder includes an outer edge, said flange extending essentially perpendicularly from said outer edge, said panel being hingedly secured to said outer edge of said second shoulder.

4. In an extruded plastic wall track including an elongated base having first and second shoulders extending outwardly therefrom and a panel hingedly secured to said second shoulder and adapted to interlock with said first shoulder, the improvement comprising an elongated flange extending from said second shoulder and spaced from said base away from a wall and adapted to support a lining material, said flange including an adhesive material thereon adapted to secure the lining material to said flange, and a removable strip of material covering said adhesive material on said flange.

* * * * *